United States Patent [19]

Griffin

[11] Patent Number: 4,985,320

[45] Date of Patent: Jan. 15, 1991

[54] PROCESSOR CHEMISTRY CONTROL STRIP READER AND REPLENISHMENT SYSTEM

[75] Inventor: Charles D. Griffin, Newark, Del.

[73] Assignee: E. I. du Pont de Nemours and Company, Wilmington, Del.

[21] Appl. No.: 492,485

[22] Filed: May 31, 1989

[51] Int. Cl.[5] ..... G03C 5/26; G03D 3/00; G03D 13/00

[52] U.S. Cl. ..... 430/30; 430/398; 430/399; 354/20; 354/298

[58] Field of Search ..... 430/30, 398, 399; 354/20, 298

[56] References Cited

U.S. PATENT DOCUMENTS

| | | | |
|---|---|---|---|
| 3,623,418 | 11/1971 | Ost | 354/298 |
| 4,081,280 | 3/1978 | Corluy et al. | 96/50 |
| 4,464,036 | 8/1984 | Taniguchi | 354/324 |
| 4,642,276 | 2/1987 | Burtin | 430/30 |

*Primary Examiner*—Richard L. Schilling
*Attorney, Agent, or Firm*—J. H. Dautremont

[57] ABSTRACT

A voltage set point system is employed to provide a constant illumination of a photographic test strip. The set voltage is used as the supply for a voltage divider comparator network for accurately determining exposed film density levels.

1 Claim, 2 Drawing Sheets

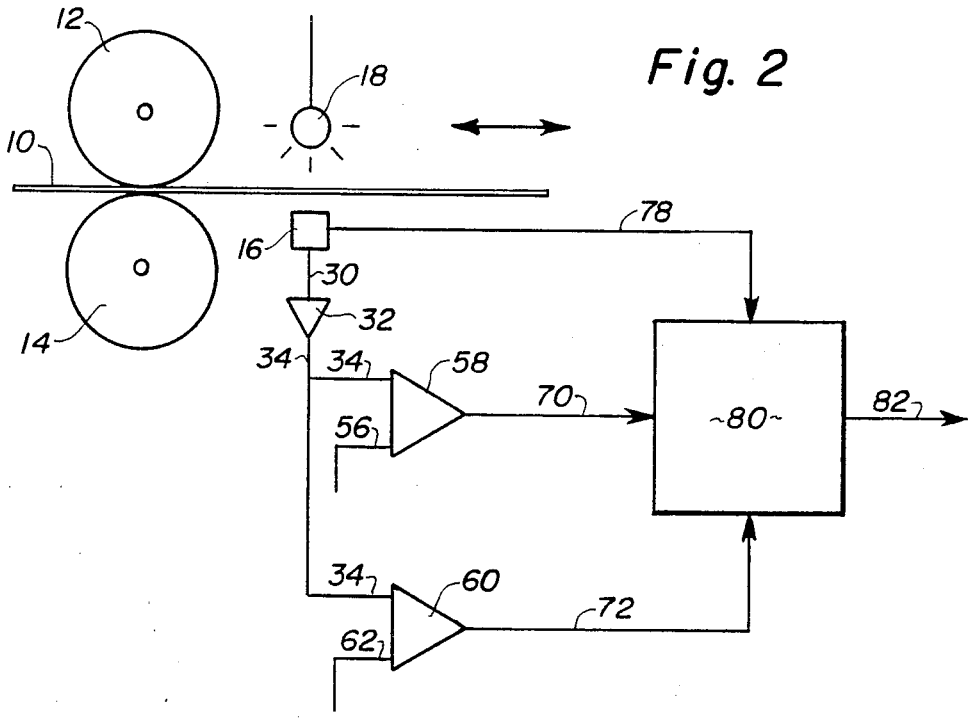
Fig. 2
Fig. 3
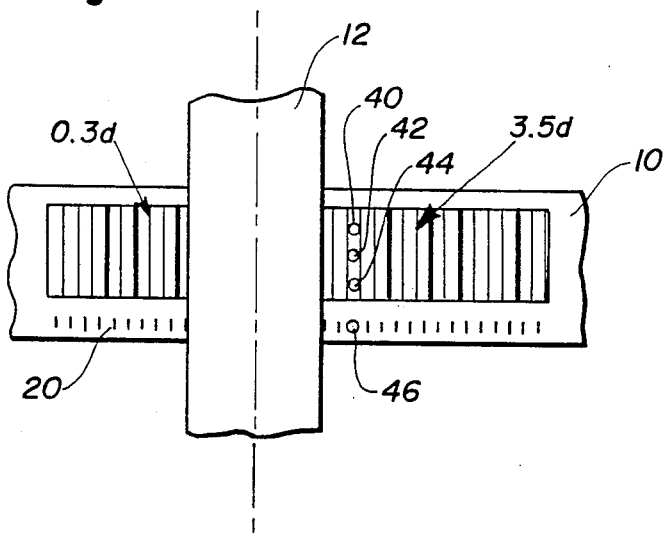
Fig. 4
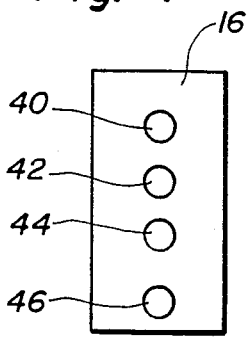

PROCESSOR CHEMISTRY CONTROL STRIP READER AND REPLENISHMENT SYSTEM

FIELD OF THE INVENTION

This invention relates to photographic film processors and more particularly to an automatic replenishment control device.

DESCRIPTION OF THE PRIOR ART

During continuous use of a developer solution for developing latent images in silver halide photographic film, the composition of the solution undergoes change as a result of several factors, including: (1) consumption of developing agents and oxidation-inhibiting compounds, (2) entry of silver halide ions into the solution, and (3) reaction of the solution with oxygen in the atmosphere. The relative amounts of developing agents in the solution become reduced by chemical reactions with exposed silver halide and by inevitable removal of developer liquid together with the photographic film segments as they leave solution.

The rate at which the developer solution becomes exhausted in the absence of replenishment depends on various factors, including: (1) temperature, (2) the extent of agitation of the solution, (3) the percent of developed (exposed or fogged) silver halide in the individual photographic film segments, and (4) the type of processed photographic film.

In the machine processing of silver halide film materials, e.g. graphic arts materials, automatic replenishment systems are commonly used for effecting automatically-controlled addition of incremental amounts of one or more replenisher solutions to the developer solutions at appropriate times in order to maintain the development conditions within prescribed tolerances.

The activity of a developer solution can be periodically assessed by using the solution to develop latent images of sensitometric control strips and subsequently comparing optical density characteristics thereof with analogous data pertaining to one or more reference control strips produced from an identical latent control strip image using a developer of a chosen standard activity level as benchmark (e.g. see U.S. Pat. No. 4,081,280 and U.S. Pat. No. 4,642,276 both of which are incorporated herein by reference).

Relative changes in the chemical composition of a developer solution during film processing can be measured by comparing the distance (hereinafter referred to as the density range) separating particular image density values on a test control strip, with the distance separating the same image density values on a reference control strip. Typical comparative image values on a reference control strip are, for example, 0.30 and 3.5. The extent of exhaustion of developer chemistry can be assessed by comparing the location of specified optical density values measured along a reference control strip with the location of corresponding optical density values along a developer test control strip. The difference between said locations can be quantified and then be used to control the extent of automatic replenishment of developer chemistry.

To facilitate these location measurements, a calibrated linear distance scale comprising regularly-spaced lines (commonly called "tick marks") runs parallel with and alongside the developed images of the reference and test control strips. These tick marks can be counted by a photodetector in a system for making automated distance measurements. The control strips can also be provided with a distinct form of mark to permit automatic detection of the positioning of the control strip in the control strip reading device. Such a position locating mark can be, for example, in the form of a notch which can be detected by mechanical means, or a spot which can be detected by means of a photodetector.

It is a common problem in the prior art that the above-described density measurements are often adversely affected by unwanted variations in the intensity of the light being employed to project through the film onto calibrated photodetectors. Also temperature changes of the photodetectors can cause changes in the "dark current" over time and can be a serious problem, since it is often impractical to require the photodetectors to be used in a constant temperature environment. These effects can lead to improper chemistry replenishment and inconsistent film development quality.

SUMMARY OF THE INVENTION

It is an object of the present invention to provide a method and apparatus wherein film control strip density value comparisons made with the aid of one or more photodetector elements result in an accurate indication of the developing activity of a photographic developer, said indication being substantially independent of the temperature of the photodetector and substantially uninfluenced by large changes in the intensity of the test light source.

In broad terms, the invention can be described as follows:

A method and apparatus for controlling replenishment chemistry in a photographic film processor, including a calibration circuit of the type using a light source and a photodetector and having one or more pre-determined density values located on a reference control strip, the location thereof being used for comparative purposes with the location of equivalent density values on a developer test control strip, the quantified difference between the measured and reference location being used to control automatically the film replenishment chemistry, wherein the improvement comprises:

generating a reference voltage based on an electrical signal output from a photodetector when no control strip is present between said light source and said photodetector, said reference voltage being maintained at a substantially constant level by means of a feedback loop which regulates the intensity of light emitted by the source, and wherein upon insertion of a freshly developed test control strip between the source and the photodetector, a set voltage substantially equals the value of said reference voltage just prior to the insertion of the control strip and, wherein said set voltage is used as a set value in a voltage ratio network including at least one comparator to identify one or more pre-set density values.

BRIEF DESCRIPTION OF THE DRAWING

FIG. 2 is an enlarged depiction of the portion of the system relating to the processing of the control strip.

FIG. 3 depicts a test control strip as it might appear during a typical reading.

FIG. 4 shows a typical arrangement of a photodetector array in accordance with the instant invention.

DETAILED DESCRIPTION OF THE INVENTION

Figure 1:
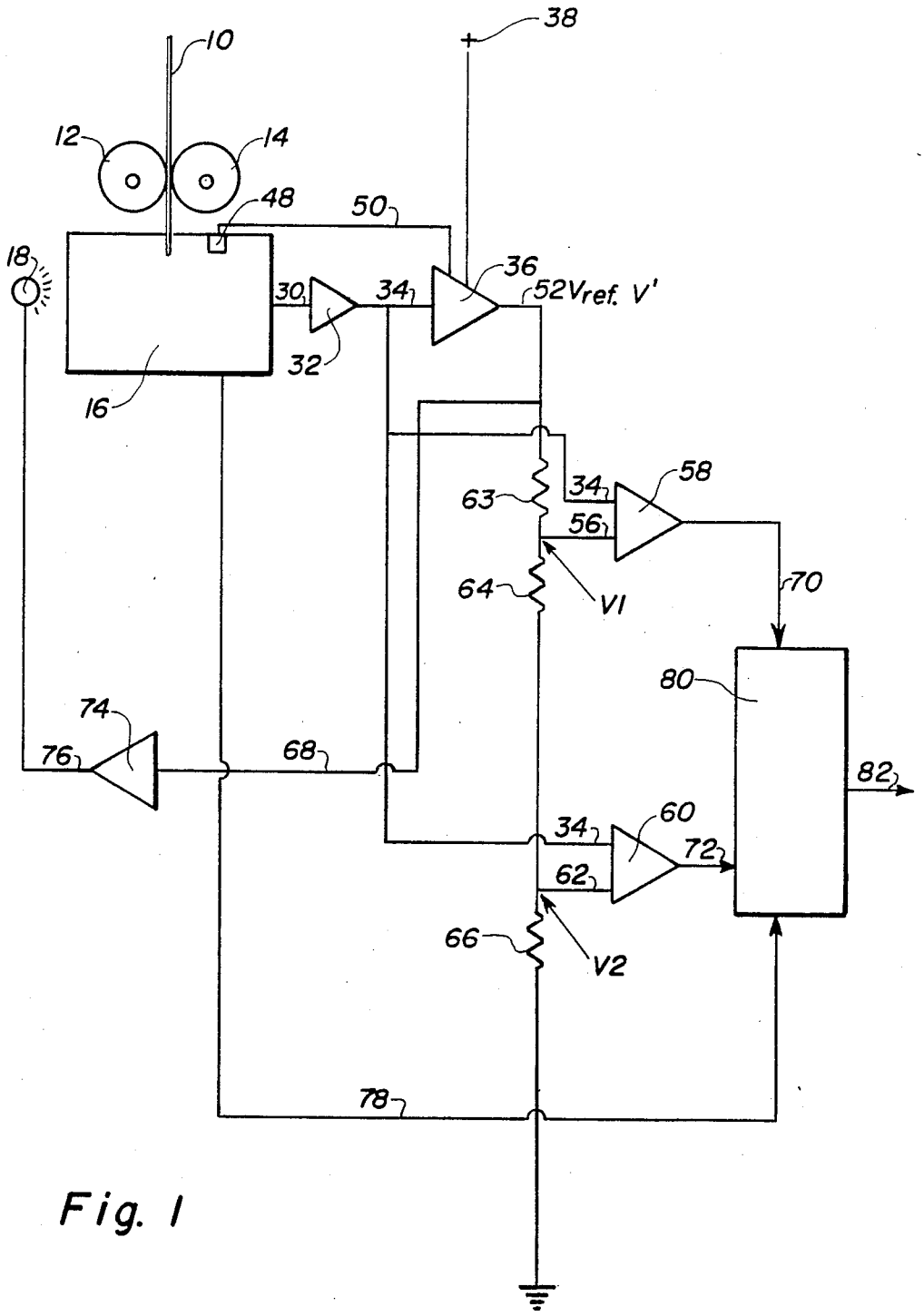
FIG. 1 is a schematic representation of a system designed in accordance with the principles of the instant invention.

Referring now to the drawing, when the apparatus is on standby, a light source 18 in a calibration circuit projects onto an array of photodetectors 40, 42, 44 and 46 contained in detector system 16. An electrical output signal of detector system 16 proportioned to the light levels sensed by the photodetectors is transmitted along wire 30 to amplifier 32. The amplified output signal is transmitted along wire 34 to a "sample-and-hold" network 36 which, corresponding to the intensity of light source 18, generates and maintains a substantially constant reference voltage $V_{ref}$ which in turn energizes a voltage divider network consisting of resistors 63, 64 and 66. A typical value for $V_{ref}$ for applicant's preferred embodiment is 10 volts. Should there be a variation in light source intensity detected, from, for example, dust on the source lamp, an inverse feedback amplifies 74 monitoring output signal in wire 52 adjusts the light intensity via an output signal transmitted along wire 76 to maintain a voltage V' near said reference voltage $V_{ref}$.

The rate at which the developer solution depletes in the absence of replenishment depends on a variety of factors, including: (1) how much film has been processed, (2) the reaction of the solution with oxygen in the air, (3) temperature, (4) agitation of the solution, and (5) the type of film developed. The practitioner then, bearing in mind the above factors, periodically inserts a freshly-developed test control strip 10 into the calibration unit to determine (within prescribed tolerances) the consistency of the developer chemistry and effect automatic replenishment as necessary.

A set of drive rollers 12, 14 is used to feed the test control strip 10 between the light source 18 and the photodetectors 40, 42 and 44 contained in detector system 16 for making density measurements and concurrently between light source 18 and photodetector 46 for "tick mark" counting. As the control strip is inserted into the calibration unit, but before passing between the light source and photodetectors, it trips a sensor 48 which sends an output signal via wire 50 to the "sample and hold" network 36 to freeze the voltage of signal 52 at its present value V' near reference voltage $V_{ref}$. The "sample and hold" network 36 will maintain a substantially constant output signal equal to V' on wire 52 and ignore further output signal changes on wire 34 as long as said output signal in wire 50 is present indicating a control strip is being read. A 20 volt power supply represented by 38 should adequately maintain the voltage V'. In this manner, one may be sure that the calibration system is reading in a like manner as it was just prior to the time that the test control strip was read when no film was present between light source 18 and detectors 40, 42, 44 and 46.

Film rollers 12 and 14 advance said control strip into detector 16 and a first tick mark is read as it crosses between light source 18 and photodetector 46. A signal 78 is sent to CPU 80 to begin counting tick marks.

The frozen voltage V' is applied via wire 52 to the top of said voltage ratio network comprising resistors 63, 64 and 66. Resistors 63, 64 and 66 of said voltage ratio network are chosen such that a voltage $V_1$ at the junction of 63 and 64 equal the voltage on wire 34 when the optical density of the reference control strip equals 0.3. Said voltage input $V_1$ to comparator 58 is taken from wire 56 at the junction between 63 and 64 in said voltage ratio network. A second input to comparator 58 reads the amplified output signal transmitted along wire 34 representing the optical density of the test control strip as film rollers 12 and 14 continue to advance the freshly developed test control strip between the light source 18 and photodetectors 40, 42, 44 and 46. When the amplified electrical signal along wire 34 produces a voltage level equal to the 0.3 reference density level equivalent $V_1$, comparator 58 sends an output signal along wire 70 to CPU 80 to record the current number of tick mark counts as representing the 0.3 optical density on the test control strip 10. Said tick mark counts are received by CPU 80 along wire 78.

Similarly, resistors 63, 64 and 66 are also chosen such that a voltage $V_2$ at the junction of resistor 64 and resistor 66 equals the voltage on wire 34 when the optical density of the reference control strip equals 3.5. Said voltage input $V_2$ to comparator 60 is taken from wire 62 at the junction between 64 and 66 in said voltage ratio network. A second input to comparator 60 reads the amplified output signal transmitted along wire 34 representing the optical density of the test control strip. In due course the control strip advances to the point where the amplified output signal along wire 34 produces a voltage $V_2$ at the input to comparator 60 that is equivalent to the 3.5 reference density voltage level $V_2$ along wire 62. An output signal from comparator 60 is sent via wire 72 to CPU 80 indicative of this second milestone being reached.

The tick mark count is noted via the signal along wire 78 and the test control strip is reversed to again measure its 3.5 and 0.3 density equivalent level voltages. The number of tick marks between said voltages on the return trip is averaged with the number counted on the forward trip and this average number or gradient for the test control strip is then compared with the number of tick marks stored in CPU 80 representing the original gradient between the 0.3 and 3.5 density values on the reference control strip; this comparison can then be used to determine the quality of the developer chemistry. The gradient values thus determined may be plotted along the ordinate of a graph vs. time along the abscissa. The gradients normally form lines of roughly zero slope. A sharp downward slope in a gradient line represents a degradation in the developer chemistry and the entire batch should be discarded and replaced.

The deviation in the number of tick marks measured for the 3.5 optical density level of the test control strip relative to the number of tick marks stored in CPU 80 for the reference control strip indicates the strength or weakness of developer activity and triggers automatic replenishment of the developer chemistry via an output signal along wire 82 as needed.

Described above is a preferred embodiment, but the subject invention is not limited thereto, rather it is defined in accordance with the scope of the appended claims.

What is claimed is:

1. A method for controlling replenishment chemistry in a photographic film processor, including a calibration circuit of the type using a light source and having one or more pre-determined density values located on a reference control strip, the location thereof being used for comparative purposes with the location of equivalent density values on a developer test control strip, the quantified difference between the measured and reference location being used to control automatically the film replenishment chemistry, wherein the improvement comprises the steps of:

generating a reference voltage based on an electrical signal output from a photodetector when no control strip is present between said light source and said photodetector, said reference voltage being maintained at a substantially constant level by means of a feedback loop which regulates the intensity of light emitted by the source, and wherein upon insertion of a freshly developed test control strip between the source and the photodetector, a set voltage substantially equals the value of said reference voltage just prior to the insertion of the control strip and, wherein said set voltage is used as a set value in a voltage ratio network including at least one comparator to identify one or more pre-set density values.

* * * * *